United States Patent [19]

Turner

[11] 4,180,178

[45] Dec. 25, 1979

[54] CONTAINER AND CLOSURE

[76] Inventor: Lloyd S. Turner, 50 Chestnut, Los Gatos, Calif. 95030

[21] Appl. No.: 536,392

[22] Filed: Dec. 26, 1974

Related U.S. Application Data

[63] Continuation of Ser. No. 860,505, Sep. 24, 1969, abandoned.

[51] Int. Cl.[2] ..... B65D 41/18; B65D 41/10

[52] U.S. Cl. ..... 220/281; 215/317; 220/306

[58] Field of Search ..... 220/281, 306; 215/9, 215/317

[56] References Cited

U.S. PATENT DOCUMENTS

| | | | |
|---|---|---|---|
| 3,128,016 | 4/1964 | Ferri | 222/143 |
| 3,170,588 | 2/1965 | Lyon | 220/306 |
| 3,387,749 | 6/1968 | Godshalk | 222/143 |
| 3,398,847 | 8/1968 | Towns | 215/9 |
| 3,484,016 | 12/1969 | Turner | 220/281 |

FOREIGN PATENT DOCUMENTS

| | | |
|---|---|---|
| 787737 | 6/1968 | Canada . |
| 442634 | 4/1927 | Fed. Rep. of Germany . |

*Primary Examiner*—George E. Lowrance
*Attorney, Agent, or Firm*—Claude A. S. Hamrick

[57] ABSTRACT

A container such as a bottle, vial or can has an enlarged lip surrounding a mouth opening, and a pliable closure which may be pressed down over the enlarged lip to secure the cap upon the container. The cap is integrally molded and comprises a top panel and peripheral skirt with an inward flange. The peripheral part of the cap including the outer portion of the top panel and the skirt is connected to a central flat area of the top panel by a circular hinge line located inside of the container mouth opening which permits relatively easy flexing at that point. To release the cap from the container, external downward pressure is applied by a person's thumb against the central flat area of the cap causing the hinge to flex and creating a pivot action between the hinge line and the outermost perimeter of the cap whereby the skirt moves upwardly over the enlarged lip of the container mouth opening. An enlargement of the container below the skirt of the closure prevents access to the bottom of the skirt such that the cap cannot be pried off from the container by any means other than described above.

5 Claims, 9 Drawing Figures

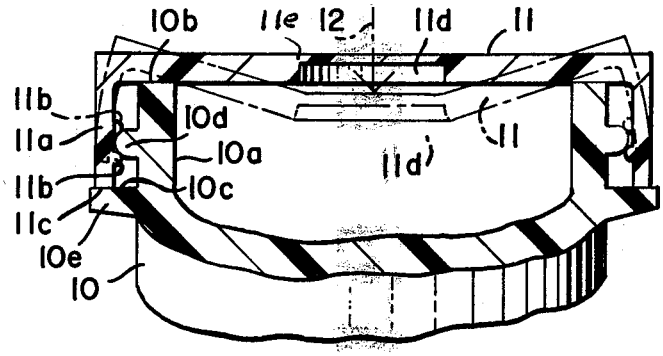
FIG. 1
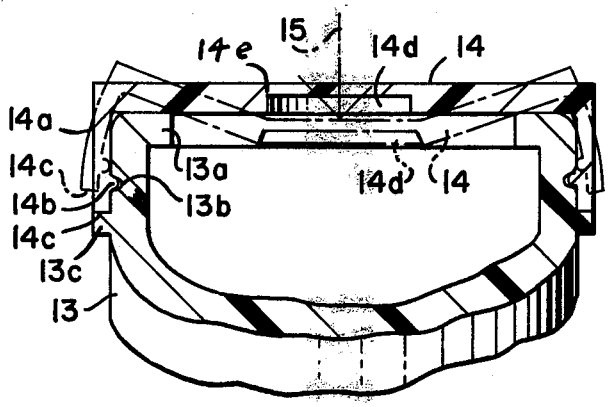
FIG. 2
FIG. 3b
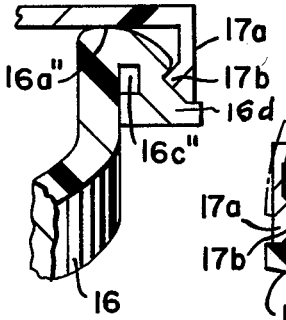
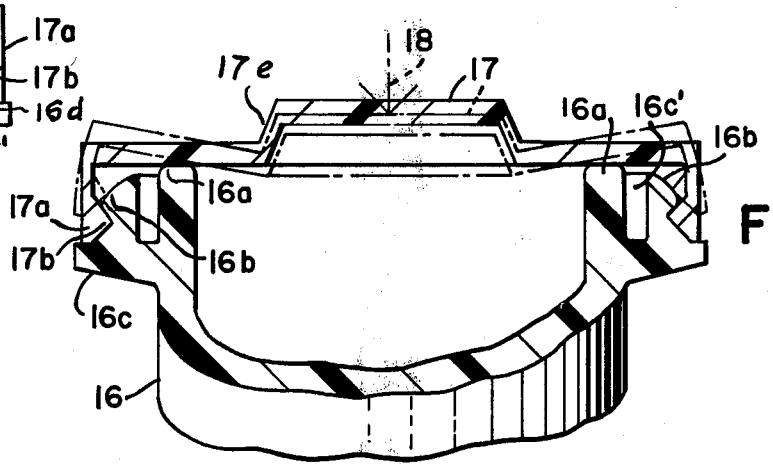
FIG. 3
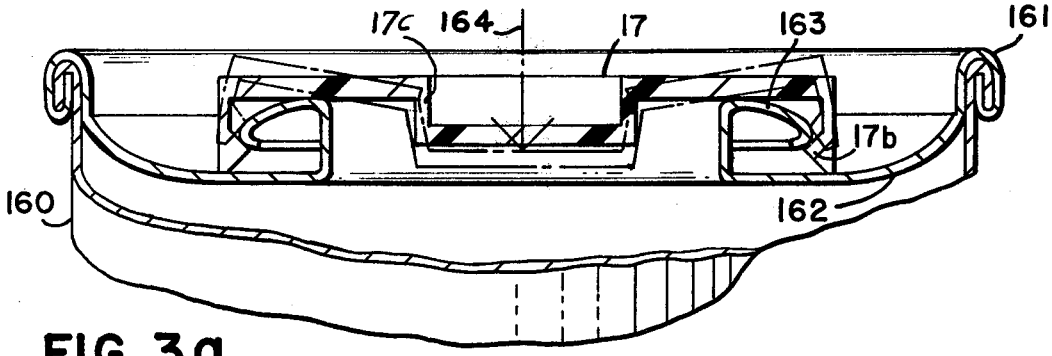
FIG. 3a

CONTAINER AND CLOSURE

This is a continuation, of application Ser. No. 860,505, filed Sept. 24, 1969, now abandoned.

DESCRIPTION OF THE INVENTION

This invention relates to closures for containers in general, more particularly this invention relates to closures or caps which are adapted to be opened only by applying pressure in a predetermined manner thereto.

An object of this invention is to provide an improved convenience type closure for containers, said closure being adapted to be easily removed from the container by adults by applying pressure tending to press the central part of the closure into the container to release the skirt of the closure from gripping the container.

Another object of this invention is to provide an improved container closure which is of the security type so that it cannot be easily opened by small children.

Another object of this invention is to provide an improved air tight container and closure of simple and inexpensive construction which may be efficiently produced in mass production.

Other and further objects of this invention will be apparent to those skilled in the art to which it relates from the following specification, claim and drawing.

In accordance with this invention there is provided a simple and inexpensive closure and container combination which may be readily produced in mass production and which is constructed so that it is substantially impossible for a small child to remove the closure from the container although it is relatively easy for an adult to perform such removal or separation. Thus this container closure combination lends itself well to packaging of articles such as medicines, pills, liquids and the like. The closure of this invention is provided with a cover member which is of generally flat circular configuration and which is provided with a relatively flat central part that is connected to the peripheral parts by a hinge. The hinge may be a line section of reduced wall thickness, an abrupt variation in the wall thickness, or a double bend which will flex. The closure is so shaped that a force applied to the center of the top thereof causes pivot action in the perifery of the top end wall section which results in an upward force at the outer perimeter of the closure. The closure is provided with a skirt that extends downwardly from the circumference of the cover member and this skirt is provided with an inwardly extending projection or bead which is adapted to be received in an annular recess or be pressed down over an enlarged lip or bead provided on the container around the outside of the mouth thereof. The inside edge around the mouth of the container functions as a fulcrum surface so that when downward pressure is applied to the top central part of the cover member the perifery part of the cover member pivots so that an opposite upward reaction occurs at the outer perimeter of the cover member and the skirt is raised so that the inwardly extending projection or bead thereof is forced up out of the annular recess or over the enlarged lip around the outside of the mouth of the container and is released from engagement with the container. The cover member may then be readily removed from the container. The container is also provided with an annular plane surface which is adapted to engage the bottom of the skirt in sealing relation. This plane surface extends completely under the bottom of the skirt when the cover member is placed on the container so that a person desiring to open the container cannot have access to the lower side of the skirt and the cover member cannot be pried off of the container from below.

Further details of this invention will be apparent to those skilled in the art to which it relates from the following specification, claims and drawing in which briefly:

FIG. 1 is a partial sectional view of an embodiment of this invention showing the cover member in solid lines in sealing relation with the top of the container and showing the cover in broken outline released from the container as a result of pressure applied to the top;

FIG. 2 is a partial sectional view of another embodiment of this invention in which the container is provided with an inwardly extending part defining the mouth and with the cover lying flat over this inwardly extending part, said cover being shown in solid lines in sealing relation with the container and in broken outline when it is being applied to the central part of the top thereof;

FIG. 3 is a partial sectional view of another embodiment of this invention in which the top of the container is provided with a downwardly sloping surface which is recessed and the inner part of which is in contact with the bottom of the flat cover, the cover being shown in solid lines in sealing relation with the top of the container, said cover being shown in broken outline when it is being released by pressure applied to the top thereof;

FIG. 3*a* is a partial sectional view showing the application of this invention to a container with recessed top;

FIG. 3*b* is a fragmentary sectional view of a further embodiment of this invention which is generally similar to the embodiment of FIG. 3 wherein the peripheral lip of the container is formed with an alternative structure.

Figure 4:
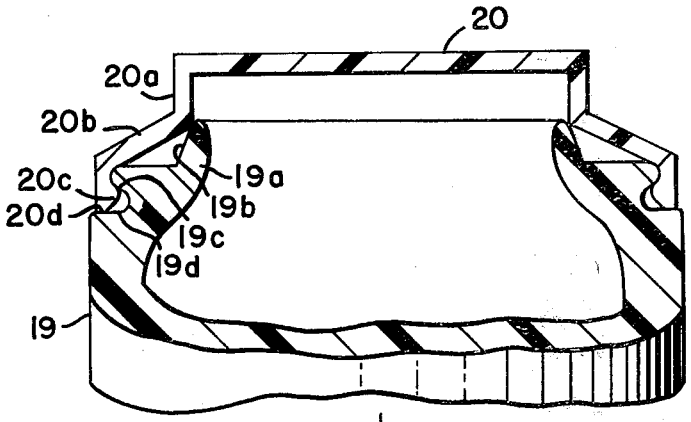
Figure 5:
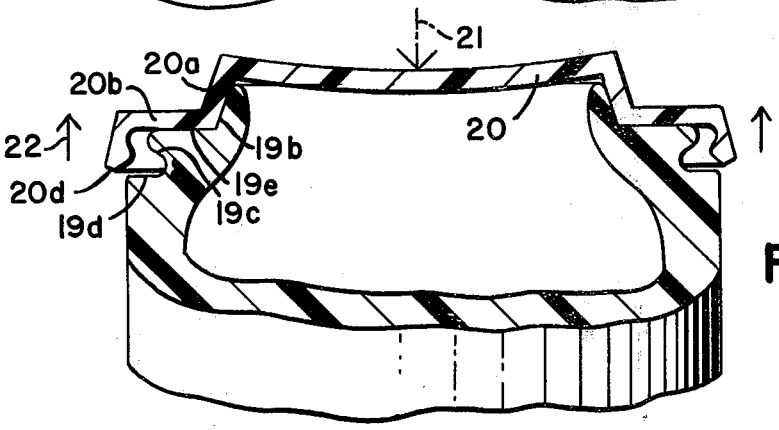
Figure 6:
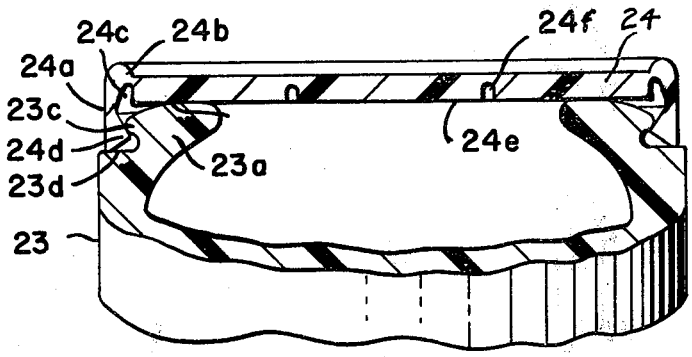
Figure 7:
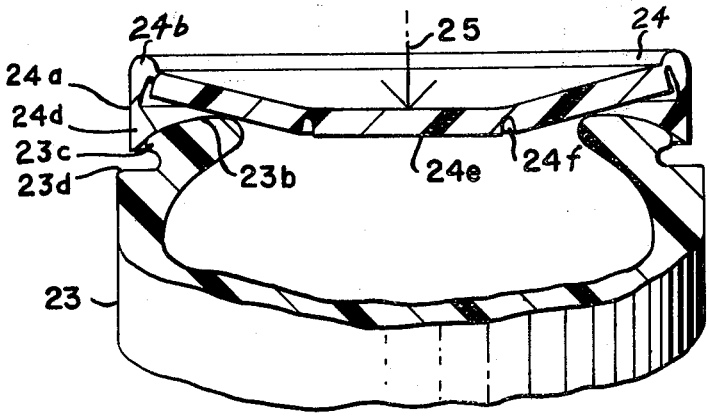

FIG. 4 is a partial sectional view of another embodiment of this invention in which the top of the container is provided with a gradually sloping cam surface around the mouth thereof for slidably contacting in inner surface of the cover and forming one of the two seals provided between the cover and the container;

FIG. 5 is a view of the cover and container embodiment of this invention shown in FIG. 4 showing the cover being deformed outwardly by cam action when pressure is applied to the top of the cover during removal of the cover from the container;

FIG. 6 is a partial sectional view of still another embodiment of this invention in which the cover is provided with a skirt attached to the periphery of the cover body around the upper peripheral portions thereof; and FIG. 7 is a partial sectional view of the container and cover arrangement shown in FIG. 6 illustrating the shape assumed by the cover body in relation to the skirt when pressure is applied to the top thereof.

Referring to the drawing in detail reference numeral 10 designates the outer portion of the container shown in FIG. 1 and reference numeral 11 designates the cover provided to this container. The container 10 is provided with a cylindrical inside wall 10*a* which extends up to the upper surface 10*b* defining the mouth of the container. The cover 11 is provided with a skirt 11*a* which has an inwardly extending bead or projection 11*b* and which extends downward so that the bottom surface 11*c* thereof engages the plane surface 10*c* of the container when the cover 11 is attached to the container. The bead 11*b* is rounded and is adapted to wedge itself under the projection 10*d* of the container thereby causing the surface 11c of the cover to seal against the surface 10c of the container. At the same time the underside of the cover 11 also engages the surface 10b of the container and provides an additional seal. The surface 10c of the container forms the top of the projection 10e which is provided around the outside of the container 10. The projection 10e extends beyond the outside of the skirt and prevents access to the bottom of the skirt so that the cover cannot be pried up by engaging the skirt bottom.

The cover 11 is recessed at 11d in the underside thereof so that the central part of the cover body is adapted to flex when pressure is applied to the top thereof in the direction indicated by the arrow 12 when it is desired to remove the cover 11 from the container 10. When this pressure is applied to the cover the recessed part 11d thereof bends and the part of the cover surrounding this recessed part tends to remain quite straight as shown in the broken outline. At the same time the outer periphery of the cover body is drawn inward so that the top of the skirt 11a is tilted inward while the skirt is pulled upward thereby causing the bead 11b to clear the outside of the projection 10d. After the pressure indicated by the arrow 12 is released from the cover 11 the cover assumes its normal shape. However, when the cover assumes its normal shape the bead 11b thereof will be positioned on top of the projection 10d so that the cover may be readily removed from the container. The recess at 11d is formed by a reduction of the wall thickness of the top panel of the cover or closure member 11. A hinge 11e is formed by an abrupt discontinuity in the wall thickness between the peripheral parts of the closure member 11 and the flat center of the top panel closing over the recess 11d. This hinge 11e extends in a line encircling the center panel of reduced wall thickness, and within fulcrum surface 10b of the container 10. The hinge 11e provides a line of flexure about which the top panel of closure member may bend when the center thereof is depressed.

In FIG. 2 there is shown another embodiment of this invention in which the container 13 is provided with a cover or cap 14 having a skirt 14a that fits the outside of the upper part of the container rather closely. The mouth of the container 13 is defined by an inwardly extending part 13a having a relatively flat upper surface. The part 13a extends inwardly a sufficient length to provide a fulcrum bearing around the inner edge thereof for the cover when pressure is applied to the cover in the direction indicated by the arrow 15.

The central part of the cover is recessed at 14d so that it flexes when pressure is applied thereto while the outer parts of the cover remain relatively inflexible as shown in broken outline in FIG. 2. When the cover 14 is thus flexed the skirt 14a thereof is lifted upwardly a sufficient amount to release the inside bead or projection 14b thereof from engagement under the recess or groove 13b formed around the container in the upper part thereof. At the same time the bottom surface 14c of the skirt is also lifted away from the plane surface forming the top of the projection 13c of the container. When the pressure indicated by the arrow 15 is released and the cover 14 attempts to resume its original unstrained shape, bead 14b remains engaged on the container just above the groove 13b so that it may be readily removed from the container.

The bottom surface 14c of the skirt engages the plane upper surface of the projection 13c rather closely when the cover 14 is secured to the top of the container so that the bottom surface 14c of the cover is completely concealed and inaccessible thereby preventing opening of the cover by applying pressure to the bottom of the skirt.

In FIG. 3 there is shown still another embodiment of this invention in which the container 16 is provided with a cover 17 having a skirt 17a with an internal wedge shaped projection or bead 17b. The top of the container 16 is provided with a surface 16a which acts as the fulcrum surface and which is adapted to be engaged in sealing relation by the cover 17 when the cover is secured to the container. The container 16 is also provided with an upwardly extending projection 16b which is spaced by a recess 16c from the part 16a. The parts 16a and 16b could be made in one piece, however, with some materials such as thermoplastics, it is more practical to provide a void therebetween to prevent an unusually thick section section which would tend to retain heat after the forming operation causing the material to change shape as it cools and cures.

The surface 16a acts as the fulcrum surface when pressure is applied to the top of the cover in the direction indicated by the arrow 18. This pressure causes the central part of the cover 17 to bend downwardly as shown in broken outline, thereby lifting the skirt 17a so that the internal projection or bead 17b thereof is lifted upward and caused to snap past the outer rounded surface of the part 16b. The recess under tha part 16b for receiving the bead 17b is just deep enough to receive the bead. When the pressure indicated by the arrow 18 is released from the top of the cover 17 the internal bead 17b is positioned on the top of this projecting part 16b and the cover then assumes its unrestrained shape and may be readily picked off of the top of the container. As shown in FIG. 3, the cover or closure member 17 is provided with a central panel to receive external pressure from a person's finger or thumb. The central panel is flat and is somewhat raised above the peripheral parts of the closure member 17 by a hinge section 17e which is a double bend arrangement. The hinge 17e encircles the central panel of the closure member, and is formed by a first bend downwardly from the central panel, a thin connecting web, and a second bend outwardly to the peripheral parts of the closure member. This double bend provides a hinge line about which the closure member may flex.

The embodiment of this invention shown by FIG. 3b is a variation of that illustrated by FIG. 3. The mouth of the container 16 is formed outwardly at the lip and thence downwardly and outwardly. In this case, a broad curved fulcrum bearing surface 16a'' is provided at the lip of the container. A downward and outward projection 16d provides essentially the same outer form as in the embodiment of FIG. 3, and is separated from the outer wall of the container 16 by a space or cavity 16c''. As in the prior embodiment, the cavity or space 16c'' provides a separation such that all parts of the container 16 are essentially of the same thickness to permit proper curing of the molded material without undue warping or change in shape.

The embodiment of this invention shown in FIGS. 4 and 5 employs a cam action between the container 19 and the cover 20 to facilitate the removal of the cover from the container. For this purpose the upper part 19a of the container is provided with an outside surface 19b which slopes inwardly and which is adapted to be engaged slidably by the part 20a of the cover when pressure is applied to the top of the cover in the direction indicated by the arrow 21. Thus as the cover 20 is pressed downward by the pressure applied thereto the part 20*a* of the cover slides downward on the cam surface 19*b* and causes the radially extending part 20*b* of the cover to move the skirt 20*d* outward so that the bead 20*c* on the inside of the skirt is moved away from the projection 19*c* of the container. The cover then may be readily lifted off of the container by an upward force indicated by the arrow 22 applied with the fingers under the skirt 20*d*. In the embodiment of FIG. 4, the hinge is provided by the part 20*a* which is formed in a double bend arrangement. A first bend is downwardly from the flat center panel of the closure member 20, and a second bend is generally outwardly to the peripheral skirt 20*d*. The two bends form a line of flexure which encircles the flat central panel.

FIGS. 6 and 7 illustrate an embodiment of this invention wherein the container 23 is provided with a cover 24 having a double hinge arrangement. The skirt 24*a* extends downwardly from a hinge line 24*b* which extends circumferentially around the periphery of the top panel. As specifically shown in FIGS. 6 and 7, the hinge 24*b* is a section of material having reduced thickness which is separated from the cover body by a space 24*c*. In other forms of this invention the hinge may be a line of reduced thickness extending circumferentially about the lower portion of the cover body, and the space 24*c* is not necessary. The top part 23*a* of the container is provided with a slightly curved surface 23*b*, the inner part of which is adapted to be engaged by the cover when the cover is secured to the container. The outer part of the surface 23*b* slopes downward to the projection 23*c* and the internal bead 24*d* of the skirt is adapted to be wedged under this projection 23*c* so that the lower part of the bead engages the plane surface 23*d* of the container. Thus the bead 24*d* is wedged between the projection 23*c* and the surface 23*d* when the cover 24 is secured to the container.

When pressure is applied to the top of the cover 24 in the direction indicated by the arrow 25 the central part of the cover body, which is recessed as shown at 24*f*, is caused to bend as shown in FIG. 7. This results in a lever action which moves the skirt 24*a* upward so that the internal bead 24*d* thereof is snapped around the projection 23*c* as shown in FIG. 7. When pressure is released from the top of the cover so that the cover resumes its normal unstrained shape the internal bead 24*d* will be resting on the outer part of the surface 23*b* and the cover may be easily lifted off of the container. The embodiment shown by FIGS. 6 and 7 provide a double hinge arrangement for flexing the cover or closure member 24. A first hinge 24*f* encircles a flat central part of the top panel and is formed by reducing the panel thickness with a groove 24*f* formed therein. A second hinge is formed at the peripheral juncture 24*b* between the skirt 24*a* and the top panel. The part 24*b* connects to the periphery of the panel, but is an abrupt variation in panel thickness as a result of the space or cavity 24*c*. The second hinge 24*b* permits the skirt 24*a* to retain its original shape when the peripheral part of the panel moves as a lever to raise the skirt 24*a* and the bead 24*d* from a secured position under the outward projection 23*c* of the container 23. Because of the hinge 24*b*, the shape and resiliency of the skirt 24*a* remains unaffected as the peripheral part of the top panel tilts and moves as a lever. Therefore the skirt 24*a* is merely pulled upwardly as the lever tilts.

While all of the closures illustrated in the drawing have been shown as extending above the top of the container it is obvious that the various closure embodiments shown may be used with containers in which the mouth is lower than the upper part of the side wall of the container as is shown in FIG. 3*a*. This container is provided with a side wall 160 which extends upward to the top junction 161. The end wall member 162 is joined in a conventional way, to the side wall 160. The walls 160 and 162 may be of metal or plastic or cardboard which may be reinforced with plastic. The end wall member 162 is recessed and terminates in the plane surface such as the surface 163 with a recess thereunder for receiving the internal bead of the skirt of the cover. This container shape structure facilitates stacking the containers one above the other since the cover is below the top surface 161 of the container, such containers are suitable for holding caustic materials and toxic powders which it is desirable to have inaccessible to children. The closure member shown in FIG. 3*a* comprises a flat central panel which is depressed somewhat by a hinge arrangement 17*c*. This hinge is a double bend arrangement which encircles the central panel as in all of the prior embodiments of this invention. However, in this case the double bend is arranged such that the central panel is depressed, and a person's finger or thumb must be inserted into the depression in order to apply the required pressure for releasing the closure. This feature provides additional security in protecting small children from the possible harmful contents of the container 160.

A further feature of this invention which enhances the security and prevents small children from releasing the closure resides in the flat central panel which must be depressed. When an adult's finger or thumb presses downwardly against the flat central panel, the area of contact may be of the order of 0.5 sq. in, and the pressure over this area may be of the order of 30 psi. This pressure is well within the capabilities of an adult. However, a child's finger or thumb is much smaller, and the area of contact between the flat central panel and the child's finger may be one fourth that of an adult. Therefore, to exert the same downward force, a child must experience a unit reaction in the order of 120 psi. While 30 psi is a reasonable pressure against a person's finger or thumb, a pressure of 120 psi is very uncomfortable and actually painful. Thus, an adult may easily remove the closures of this invention while a child would be unable to do so.

The security cap of this invention is molded integrally of a pliable plastic material which may be deformed by external pressure from a person's thumb, but which will always return to its original shape when the external pressure is removed. It will be appreciated that after the cover or closure member has been removed from a container, the cover remains in the same shape and configuration as when secured over the container. To replace the cover and resecure the container, the cover is merely pressed over the mouth of the container. It is not necessary that the cover be "cocked" in a special condition prior to being seated upon the container mouth. This one feature which distinguishes the security cover of this invention from, commercially available "snap cap" which are formed of metal. The prior art "snap caps" may be "cocked" or "snapped open" by downward pressure against the center, and may be "snapped on" by either a downward or lateral pressure against the sides. To resecure a bottle with a "snap cap", one must first make certain that the cap is "cocked" by center pressure; thence, the cap is seated upon the mouth of the bottle; and thence, side pressure must be used to snap the cap into a secured position. In this invention, the pliable plastic cover always retains its original shape. The cover need not and cannot be "cocked" to a different shape; and after the cover is pressed downwardly over the container mouth, there is no further step of pushing the edges to reset the device. Therefore, the applicant's pliable plastic closure member provides a security closure which is simpler and better than the "snap caps" of the prior art.

The invention is claimed as follows:

1. A container and a closure member therefor, said container comprising a mouth opening having a circumferential upper surface providing a fulcrum bearing and an outward projection extending circumferentially around the mouth opening, said closure member being formed of a pliable plastic material having a single normal configuration and comprising a cover panel having a flat top surface near the center thereof and having a circumferential skirt depending from the periphery thereof, said skirt of the closure member having an inward flange adapted to be pressed over the outward projection about the mouth of the container for securing the closure member upon said container, said cover panel of the closure member being formed with a hinge line encircling the flat surface in the center and disposed inside of the container mouth opening, said skirt of the closure member being normally operable to hold the inward flange in a secured position below the outward projection around the mouth opening of the container and being further operable axially to release the inward flange from the secured position when the flat central surface of the panel is depressed by external force to pivot the peripheral part of the cover panel about the hinge line and the fulcrum bearing of the upper surface of the container, said container having a planar surface extending outwardly below the skirt to prevent access to the bottom of the skirt whereby the closure member cannot be pried up from the container, an enlargement in the container spaced below the outward projection to form an annular groove therebetween, said inward flange of the skirt of the closure member normally extending into the annular groove in the secured position, the circumferential upper surface of the mouth opening of the container being positioned to abut against and provide a fulcrum bearing for the closure member, said fulcrum bearing being disposed circumferentially outside of the hinge, said closure member being operable to be deformed from the single normal configuration in response to the external force and pivot as a lever about said fulcrum bearing when the center is depressed to move the inward flange upwardly from the secured position in the annular groove and thereafter returns to the single normal configuration with the release of said force on the center, said hinge line being formed by a discontinuity in the thickness of the material forming the cover panel of the closure member, said flat central panel being formed of a thickness which is substantially less than the thickness of the peripheral parts of the cover panel, the parts being joined to form the hinge line with an abrupt change in material thickness.

2. A container and a closure member therefor, said container including a mouth opening having a circumferential upper surface providing a fulcrum bearing and an outward extending projection extending circumferentially around the mouth opening, said closure member being formed of a pliable material having a single normal configuration comprising a cover panel having a flat top surface near the center thereof and having a continuous circumferential skirt depending from the periphery of the cover panel, said skirt of the closure member having an inward extending flange which deflects over and engages the container outward projection when the closure member is placed in position over the mouth of the container and pressed downward towards the mouth to a sealed position in which position the circumferential upper surface around the mouth opening of the container abuts the under surface of the cover panel at a position spaced towards the center of the cover panel from the circumferential skirt of the closure member, said cover panel including a line of marked reduction in thickness encircling a portion of the flat top surface at a position radially inward from the position the container circumferential upper surface abuts the under surface of the cover panel forming a hinge line separating the top panel surface into a center portion and a substantially stiff outer portion and enabling bending of the top surface therebetween, said skirt and flange of the closure member being normally operable to deform and deflect over the container outward extending projection when the closure is pressed towards the container mouth thereby to hold the closure in position sealing the container mouth closed with the skirt and included flange resisting expansion of the skirt circumferentially which otherwise would release the flange from the engaged position extending below the container outward projection, said closure member being removable from the engaged position over the container projection in response to a downward pressure against the center portion of the flat top surface of the closure of sufficient force to deform and bend the top panel at the hinge line causing a pivoting of the stiff outer portion of the cover panel about a fulcrum bearing formed by the abutting container mouth upper surface thereby pulling the skirt upward in a direction substantially perpendicular to the closure cover panel and causing the skirt flange to deflect over the container outward projection and move to a position above the projection whereby with the release of pressure the closure member is unsealed from the container mouth and returns to its single normal undeformed configuration with the skirt flange positioned above the container outward projection and resting loosely on the container mouth for easy removal therefrom.

3. A container and a closure member therefor as defined in claim 2 in which said container includes a planar surface extending outwardly below the skirt to prevent access to the bottom of the skirt so the closure member cannot be pried from the container.

4. A container and a closure member therefor, said container including a mouth opening, said closure member being formed of a pliable material having a single normal configuration comprising a cover panel having a flat top surface near the center thereof and having a depending circumferential skirt extending from the periphery of the cover panel, said skirt of the closure member and said container having projection and recess members comprising cooperating engaging parts to hold the closure member on the mouth when the closure member is placed in position over the mouth of the container and pressed downward towards the mouth to a sealed position, said cover panel including a line of marked reduction in thickness encircling a center portion at a position radially inward from the skirt of the closure to form a hinge line separating the cover panel into a substantially stiff center portion and substantially stiff outer portion and enabling bending of the cover panel therebetween, said skirt of the closure member being continuous and fixed to the outer portion of the cover panel and being normally operable to expand circumferentially and allow the cooperating projection and recess members on the skirt and container to be forced into engagement when the closure is pressed towards the container mouth thereby holding the closure in a sealed position over the container mouth with the skirt resisting expansion circumferentially which otherwise would release the projection and recess members from the engaged position, said container mouth including a circumferential upper surface extending around the mouth opening which surface abuts the under surface of the outer portion of the cover panel at a position between but radially spaced from both the panel hinge line and the depending skirt, said container having a flat surface extending outwardly in a plane below the skirt when the closure member is in the sealed position for preventing access to the exposed end of the skirt and disengagement of the closure member from the container by prying upward on the skirt, said closure member being removable from the sealed position in response to an externally applied downward pressure in the axial direction against the center portion of the cover panel of sufficient force to cause a downward movement of the center portion and bend the cover panel at the hinge line and pivot the stiff outer portion of the cover panel about the abutting container mouth upper surface thereby pulling the skirt axially upward in a direction opposite to the downward movement of the center portion of the closure cover panel with such force that the skirt and container engaging members are forced from the engagement whereby with the release of the external downward pressure the closure member returns to its single normal configuration but resting loosely on the container mouth for easy removal therefrom.

5. A container and a closure member therefor, said container including a mouth opening, said closure member being formed of a pliable material having a single normal configuration comprising a cover panel having a depending circumferential skirt extending from the periphery of the cover panel, said skirt of the closure member and said container having projection and recess members comprising cooperating engaging parts to hold the closure member on the mouth when the closure member is placed in position over the mouth of the container and pressed downward towards the mouth to a sealed position, said cover panel including a line of marked reduction in thickness encircling a center portion at a position radially inward from the skirt of the closure to form a hinge line separating the cover panel into a substantially stiff center portion and a substantially stiff outer portion and enabling bending of the cover panel therebetween, said skirt of the closure member being continuous and fixed to the outer portion of the cover panel and being normally operable to increase in diameter by elongating circumferentially and allowing the cooperating projection and recess members on the skirt and container to be forced into engagement when the closure is pressed towards the container mouth thereby holding the closure in a sealed position over the container mouth with the skirt resisting expansion circumferentially which otherwise would release the projection and recess members from the engaged position, said container mouth including a circumferential upper surface extending around the mouth opening which surface abuts the under surface of the outer portion of the cover panel at a position between but radially spaced from both the panel hinge line and the depending skirt, said closure member also being removable from the sealed position in response to an externally applied downward pressure in the axial direction against the center portion of the cover panel of sufficient force to cause a downward movement of the center portion and bend the top panel at the hinge line resulting in a pivoting of the stiff outer portion of the cover panel about the abutting container mouth upper surface thereby pulling the skirt axially upward and causing it to move in a direction opposite to the downward movement of the center portion of the closure cover panel causing the skirt and container engaging members to be forced from the engagement whereby with the release of the external downward pressure the closure member returns to its single normal configuration but resting loosely on the container mouth for easy removal therefrom, said container also having a flat surface extending outwardly in a plane below the skirt when the closure member is in the sealed position for preventing access to the exposed end of the skirt and disengagement of the closure member from the container by prying upward on the skirt, and that inwardly spaced portion of said closure member cover panel positioned radially inward from the position at which the container upper surface abuts the under surface of the cover panel outer portion being of equal or lower heighth above the container than the highest portion of the cover panel portion spaced radially outward from that inwardly spaced portion such that stacking of the containers and closures one above the other will not depress the cover panel center portion and cause the closure to become unsealed.

* * * * *